US011731036B2

(12) United States Patent
Kulhanek

(10) Patent No.: US 11,731,036 B2
(45) Date of Patent: Aug. 22, 2023

(54) BALL LAUNCHER AND A BALL GAMING SYSTEM INCLUDING SUCH BALL LAUNCHER

(71) Applicant: Novomatic AG, Gumpoldskirchen (AT)

(72) Inventor: Christian Kulhanek, Gumpoldskirchen (AT)

(73) Assignee: Novomatic AG, Gumpoldskrichen (AT)

( * ) Notice: Subject to any disclaimer, the term of this patent is extended or adjusted under 35 U.S.C. 154(b) by 642 days.

(21) Appl. No.: 16/637,725

(22) PCT Filed: Aug. 10, 2018

(86) PCT No.: PCT/EP2018/071833
§ 371 (c)(1),
(2) Date: Jun. 16, 2020

(87) PCT Pub. No.: WO2019/038111
PCT Pub. Date: Feb. 28, 2019

(65) Prior Publication Data

US 2021/0362037 A1 Nov. 25, 2021

(30) Foreign Application Priority Data

Aug. 23, 2017 (EP) ..... 17187401

(51) Int. Cl.
*A63F 5/00* (2006.01)
*A63F 7/24* (2006.01)

(52) U.S. Cl.
CPC ..... *A63F 5/0005* (2013.01); *A63F 5/007* (2013.01); *A63F 5/0076* (2013.01); *A63F 7/2409* (2013.01)

(58) Field of Classification Search
CPC ..... A63F 5/0005; A63F 5/00; G07F 17/322
See application file for complete search history.

(56) References Cited

U.S. PATENT DOCUMENTS 4,337,945 A * 7/1982 Levy ..... A63F 9/0079 273/142 E
4,391,442 A * 7/1983 Levy ..... A63F 9/0079 273/142 E
4,869,505 A 9/1989 Manabe
4,906,005 A 3/1990 Manabe
6,047,965 A 4/2000 Mollo et al.
6,520,854 B1 * 2/2003 McNally ..... A63F 5/00 273/142 D (Continued)

FOREIGN PATENT DOCUMENTS

WO 2015114302 A1 8/2015
ZA 9807903 A 3/1999

*Primary Examiner* — Eugene L Kim
*Assistant Examiner* — Christopher Glenn
(74) *Attorney, Agent, or Firm* — Kevin H. Fortin, Esq.

(57) ABSTRACT

The present invention generally relates to a ball gaming system such as a roulette wheel apparatus, and in particular to a ball launcher for use in a gaming system such as a roulette wheel apparatus and to a gaming system such as a roulette wheel apparatus comprising the ball launcher, wherein the ball launcher includes a ball shuttle for transporting a ball from at least one ball-receiving station to at least one launch tube. According to the present invention, said ball shuttle is configured to move to a reject-ball station in response to a reject-ball signal to transport any old and/or defective ball to said reject-ball station instead of said at least one launch tube.

19 Claims, 4 Drawing Sheets

(56) References Cited

U.S. PATENT DOCUMENTS

| | | | | |
|---|---|---|---|---|
| 8,282,100 | B2 * | 10/2012 | Kido | G07F 17/3216 273/142 E |
| 2005/0217208 | A1 * | 10/2005 | Cicognani | B65B 57/14 53/54 |
| 2006/0012790 | A1 * | 1/2006 | Furze | G01N 21/951 356/402 |
| 2006/0222231 | A1 * | 10/2006 | Harris | G06T 7/0006 382/141 |
| 2008/0132315 | A1 * | 6/2008 | Fisher | A63F 5/02 273/143 R |
| 2008/0132316 | A1 * | 6/2008 | Fisher | A63F 9/20 463/17 |
| 2010/0120488 | A1 * | 5/2010 | Savytskyy | G07F 17/32 273/142 E |
| 2010/0124966 | A1 * | 5/2010 | Kido | G07F 17/34 273/142 E |
| 2013/0214486 | A1 * | 8/2013 | Shelburn | A63F 5/00 273/142 E |

* cited by examiner

BALL LAUNCHER AND A BALL GAMING SYSTEM INCLUDING SUCH BALL LAUNCHER

FIELD OF THE INVENTION

The present invention generally relates to a ball gaming system such as a roulette wheel apparatus, and in particular to a ball launcher for use in a gaming system such as a roulette wheel apparatus and to a gaming system such as a roulette wheel apparatus comprising the ball launcher, wherein the ball launcher includes a ball shuttle for transporting a ball from at least one ball-receiving station to at least one launch tube.

BACKGROUND OF THE INVENTION

It has previously been proposed to provide an automatic roulette wheel assembly comprising a roulette wheel having a number of slot compartments circumferentially arranged. The wheel is rotated by a motor and a ball fire mechanism is arranged to fire/launch a roulette ball onto the rotating wheel so that the ball, after passing a zone having obstacles for diverting/deflecting the ball, will land in one of the (numbered) slot compartments, which process is being regarded as drawing a random number.

The automatic roulette wheel assembly may comprise a return mechanism to return the ball from the slot in which it lands back to the firing mechanism. Such an automatic roulette wheel assembly may be used to provide a game of roulette operated by a croupier taking bets and paying out winnings in a casino.

It has previously been further proposed to provide a fully automatic roulette wheel assembly by providing such an automatic roulette wheel assembly together with means to identify the slot compartment in which the ball lands, and means for users to place bets and receive any winnings. Such a fully automatic roulette wheel assembly may be used to provide a game of roulette without requiring any human operator, either in a casino or remotely, for example with the game being viewed and bets placed by, and winnings paid to, players via an electronic interface and over the Internet.

Document US 2010/0124966 discloses a roulette game system wherein the ball may be launched by means of applying an accelerating force to the ball by air discharged from discharge openings provided in an edge portion of the gaming area. Starting and stopping the discharge of the pressurized air is controlled by a timer, wherein bet end timing is set through an external operation by staff in a game hall or a controller so as to make sure that it is impossible or at least to add difficulty to predict a location at which the ball falls. More particularly, pressurized air injected into the landings or pockets of the roulette wheel via nozzels associated with said pockets force the ball from the respective pocket radially outwards towards the outer rim of the roulette wheel where additional air nozzels arranged substantially tangential to the outer rim of the roulette playing area discharge pressurized air to force the ball to roll along the bank path at the upper edge of the roulette playing area. Thus, the ball does not leave the playing area and a usual launching unit for launching the ball from outside into the playing area can be dispensed with. To avoid blowing of the ball beyond the outer rim to the outside of the roulette playing area, the upper side of the playing area is closed by a transparent cover having a hemispherical shape.

Document U.S. Pat. No. 4,906,005 discloses a roulette playing device where the ball is launched into the playing area from the outside by means of a ball launch device using pressurized air to convey the ball through a launching tube. To allow for a fully automatic operation of the game, a ball that has landed into one of the pockets of the roulette wheel, may be discharged into a collection funnel below the roulette wheel by means of lowering the roulette wheel to allow the ball to roll from the pocket into said collection funnel from which it may roll into a gating device from where the ball is conveyed by means of pressurized air to a spinning device hitting out the ball back into the playing area. Such spinning device includes a pair of driven rollers having a distance from each other smaller than the ball's diameter so that the ball sent to the spinning device by means of pressurized air is caught in the opening between the two rollers which are then driven at different rotational speeds, thus giving spin to the ball when it is injected into the gaming area.

A similar ball spinning device is disclosed by WO 2015/114302 A1 showing a ball launcher having a pair of driven wheels spaced apart from each other at a distance smaller than the ball's diameter. The driving direction of said pair of wheels can be changed, thus allowing to fire the ball in either of two opposite directions.

Furthermore, U.S. Pat. No. 6,047,965 discloses a roulette gaming device using pressurized air to further randomise the gaming results. More particularly, the so-called canoes forming the obstacles between the outer bank path and the rotating roulette wheel are provided with air nozzels to inject pressurized air onto the playing area in substantially diagonal directions.

When relaunching a used ball coming from the playing area back into said gaming area, there are sometimes problems due to wear and tear or soiling of the ball what may occur in the course of use. Wear and tear of the ball and in particular pollution of the ball may result in changes in the surface texture such as a reduced surface smoothness or an increased surface roughness, or even worse in deviations from a spherical shape due to surface pittings or polluting agglomerations. Such "bad" balls may influence the launching process so the ball may be shot into the playing area with reduced speed, or the ball may not smoothly pass through the launch tube, wherein such problems may occur particularly when using airflow systems for driving the ball through the launch tube by airflow through the launch tube.

Aside from such launching problems, wear and tear of the ball and changes to the surface thereof may detrimentally affect ball recognition to determine in which of the slot compartments of the roulette wheel the ball has landed. In automatic roulette systems, ball recognition in the respective slot compartment is often based on optical recognition what is difficult when the ball has no longer its typically expected surface appearance.

Document U.S. Pat. No. 4,391,442 B suggests to not play with only one ball and to not recirculate the same ball after each game back into the roulette gaming area, but to use a plurality of balls one after the other coming from a ball storage. Such approach certainly extends the life of each ball as its playing time is reduced to, e.g., one fifth if there are five balls in total. However, if a polluted ball or a defective ball is returned to the ball storage, it will be relaunched automatically, thus causing problems in optical recognition of the ball in the respective compartment slot of the roulette wheel. If the defect of the ball in the ball storage is more severe, the launch process may be affected or disturbed.

OBJECT AND SUMMARY OF THE INVENTION

It is a general objective underlying the present invention to provide for an improved ball gaming system avoiding disadvantages of the prior art and achieving improved functionality.

Another more particular objective underlying the present invention is to provide for an improved ball game system avoiding malfunctioning due to pollution and wear and tear of the ball.

Another particular objective underlying the invention is to provide for an improved gaming system that allows for reliable optical recognition of the ball in the landings of the gaming area.

Another objective underlying the invention is to allow for a reliable relaunching of a ball into the gaming area to avoid lengthy downtimes.

A further objective underlying the invention is to provide for a simple but reliable ball launcher for launching the ball in different directions with spin into the playing area of the gaming system.

Finally, it is also desired to increase the level of interest, excitement and volatility associated with playing the game.

According to the present invention, such objective is achieved by a ball launcher as defined in claim 1 and a gaming system including such ball launcher. Preferred embodiments of the invention are laid down in the dependent claims.

More particularly, to achieve at least one of the aforementioned objectives, the present invention provides for a ball launcher including a ball shuttle which is adapted to be movable from at least one ball-receiving station to said at least one launch tube to transport the ball from the ball-receiving station to said at least one launch tube.

According to the present invention, said ball shuttle is configured to move to a reject-ball station in response to a reject-ball signal to transport any ball to be replaced/exchanged, e.g. old and/or defective ball, to said reject-ball station instead of said at least one launch tube. When the ball transported by the shuttle is a "bad" ball, the shuttle does not transport such bad ball to the at least one launch tube to avoid launching such bad ball into the gaming area, but transports such bad ball to the reject-ball station to sort out or separate such bad ball. Advantageously, there is no mandatory or automatic launching of a ball as soon as it is received by the ball shuttle, but the ball shuttle may sort out such bad balls and transport only good/desired balls to the launch tube.

Such ball transport to a reject-ball station is particularly advantageous in combination with a ball storage from which new balls may be taken when a polluted or defective ball has been transported to the reject ball station to sort out such polluted and/or defective ball. More particularly, said ball shuttle may be adapted to be movable to a first ball-receiving station for receiving a used ball coming from the playing area and to a second ball-receiving station for receiving a new ball from a ball storage connectable to said second ball-receiving station.

Thus, the same shuttle may be used to relaunch a used ball, to separate/sort out a ball to be replaced/exchanged, for instance defective, ball and to launch a new ball to replace a bad ball sorted out. Consequently, a compact, space-saving arrangement with a small number of components is achieved.

The decision if a used ball is good enough to be relaunched or bad to be sorted out, can be made automatically by a ball detector or can be made manually by a player or a user who may input the reject-ball signal manually via input means connected to a controller for controlling the ball launcher. Such manually operable input means may comprise a movable key or switch or a touch-sensitive touch screen element, and/or may comprise other types of input means such as a gesture sensor for inputting the reject-ball signal in terms of a specific gesture such as a wiping movement of a hand, or voice recognition means for inputting the reject-ball signal acoustically. Other types of input means may be provided.

So as to achieve automatic ball quality recognition, a ball quality detector may be provided for detecting ball quality and issuing said reject-ball signal upon detection of a defective and/or polluted ball. Such ball quality detector may be configured to issue such reject ball signal also upon detection of any ball of unknown quality so as to avoid game playing with unknown balls. Such automatic ball detection may be provided in addition to or in the alternative to the aforementioned manual input means.

Such automatic detection of ball quality may be achieved in different ways, in particular using different detector types. According to an advantageous embodiment, the ball quality detector may include an optical sensor to optically detect ball quality. More particularly, an imaging sensor and/or a camera may provide for an image of the ball, wherein an image evaluator may evaluate the image of said ball provided by said imaging sensor and/or said camera to determine ball quality.

Said image evaluator may be configured to analyze various and/or more than one image characteristics, wherein the image evaluator may compare the analyzed characteristic to a reference value and/or a reference characteristic that may be stored in a storage unit. For example, the image evaluator may carry out a contour analysis. More particularly, the image may be analyzed to determine the outer contour of the ball, wherein the detected contour may be analyzed to determine deviations of the outer contour from a circular contour. For example, when pollutions such as small clots or agglomerations stick to the surface of a ball, the outer contour may show a small bump.

In the alternative or in addition, the image evaluator may be configured to determine changes and/or irregularities in color and/or in brightness of said image of said detected ball. More particularly, a new ball may have a polished, shiny surface that reflects or mirrors light, whereas a polluted ball may have a more lusterless or dull surface less shiny and reflecting light to a reduced extent only. In the alternative or in addition, pollutions of the ball may result in changing colors in terms of, e.g., gray areas in the otherwise silver surface, or, depending on the type of pollution, other color deviations such as red or green points or areas in the ball image.

According to an advantageous embodiment, the image evaluator may be configured to effect a pixel analysis of the image and/or to detect a pixel pattern in said image to be compared to a predetermined pixel pattern representing a new ball.

So as to improve optical detection of ball quality, the ball quality detector may include a light source for illuminating the ball surface when taking an image by the imaging sensor and/or the camera. Such light source may provide for a predetermined light pattern such as a linear pattern of light onto the ball surface, whereas on the other hand also a uniform illumination may be provided. The light source may be configured to apply light of a certain temperature and/or color and/or of a certain wave length onto the ball surface when detecting the ball quality. Such illumination of the ball may be helpful, e.g., for determining the reflectivity of the surface and/or to enhance the contrast of the ball contour relative to the surrounding.

The detection of ball quality may be associated with various regions of the ball launcher and/or the gaming system. For example, the ball quality may be detected when the ball is on the playing area. In case of a roulette game, the ball quality may be detected when the ball is in one of the compartments of the roulette wheel. More particularly, the ball quality detector may be integrated into and/or associated with the ball recognition system for determining the winning number and/or monitoring the game result. The determining system which determines the compartment of the roulette wheel in which the ball has landed, may be configured optical and/or may include a camera or an imaging sensor providing for an image of the ball landed in the respective compartment. Such image may be used for determining ball quality, wherein the aforementioned image evaluator may analyze the image of the ball. In the alternative or in addition, the ball detector may detect ball quality when the ball to be detected is in said at least one ball-receiving station where the shuttle may pick up the ball to transport it to one of the launch tubes or to the reject-ball station. Thus, the ball quality detector may be positioned at said ball-receiving station. Quality detection may be carried out when the ball is not moving, but in a static position at said ball-receiving station.

In addition or in the alternative, quality detection may be effected when the ball is positioned in/on said ball shuttle, wherein the ball quality detector may be positioned and/or mounted at said ball shuttle. When mounted onto the ball shuttle, the ball quality detector may move together with the ball shuttle so transfer time may be used for ball detection. In the alternative or in addition, a ball quality detector may be arranged stationary, for example fixed to a mounting frame movably supporting the ball shuttle or a housing, and may detect a ball received in a ball-receiving recess of said ball shuttle, wherein ball detection may be effected when the ball shuttle is not moving. In the alternative, ball quality detection may be effected also when the ball is moving with the ball shuttle, wherein a stationary ball detector may take a picture of the moving ball which picture is then evaluated.

In addition or in the alternative to the aforementioned optical sensor, the ball quality detector also may include sensors of other types such as, e.g., a weight sensor, a magnetic sensor for determining the magnetic properties of the ball, and/or an electric sensor for measuring, e.g., electric conductivity of the ball. It may be mentioned that ball quality may include characteristics like color, surface structure, weight of the ball etc.

The aforementioned optical sensor such as an imaging sensor or a camera may include one or more of the following: a CCD sensor, a CMOS sensor, a thermal imaging sensor, a radar imaging sensor, a sonar imaging sensor, a color filter array sensor, a pixel sensor, a multi-spectral image sensor.

According to an advantageous embodiment, the ball shuttle may include a shuttle rotor having a ball-receiving seat and being rotatably supported about a shuttle rotor axis, wherein said ball-receiving seat and an opening of said at least one launch tube are positioned on a circular path around said shuttle rotor axis. Said shuttle rotor may be driven to rotate about said shuttle rotor axis so that said ball-receiving seat moves along a circular path to bring the ball-receiving seat into registration with the ball-receiving station and the opening of the launch tube, depending on the rotatory position of said shuttle rotor.

Advantageously, it is not only said at least one launch tube that is positioned on a circular path around the shuttle rotor axis, but also the aforementioned ball-reject station and/or the at least one ball-receiving station may be positioned on said path of the ball-receiving seat about said shuttle rotor axis. Thus, said ball-receiving seat may receive a ball from anyone of said first and second ball-receiving stations, and a ball received in said ball-receiving seat of the shuttle rotor may be transported to anyone of said ball-reject station and said launch tubes.

The aforementioned ball storage for providing new balls to the ball shuttle, may be configured to transport the stored balls onto the ball shuttle by means of gravity. For example, the ball storage may include a feeding path sloped or inclined to a horizontal line, wherein such sloped feeding path may lead to said second ball-receiving station, so that a new ball is conveyed onto the ball-receiving seat of the ball shuttle by means of gravity when said ball-receiving seat is in the ball-receiving position at said second ball-receiving station.

In addition or in the alternative, also the reject-ball station may be configured to transport a "bad" ball away from the ball shuttle by means of gravity. For example, the reject-ball station may include a sloped discharge path for discharging any ball by gravity.

When the ball shuttle is configured as a shuttle rotor as mentioned above, it may be advantageous when the shuttle rotor axis of rotation is aligned substantially horizontal. So as to support the aforementioned ball transport by gravity, the first and/or second ball-receiving station may be positioned above a horizontal plane containing said horizontal axis of rotation of the shuttle rotor. In other words, the ball-receiving station may be aligned with the upper half of the shuttle rotor and/or the upper half of the circular path of the ball-receiving recess. On the other hand, the reject-ball station may be positioned below said horizontal plane containing the horizontal axis of rotation so that the reject-ball station is aligned with the lower half of the shuttle rotor and/or the lower half of the circular path of the ball-receiving seat around said axis of rotation.

As sorting out a bad ball at the reject-ball station is a sort of extraordinary operation, whereas usually a ball coming back from the gaming area is relaunched, it may be advantageous to have the at least one launch tube positioned next to the ball-receiving station. In particular, the at least one launch tube may be closer to the ball-receiving station than the reject-ball station. More particularly, the first ball-receiving station may be positioned at an uppermost portion of the circular path of the ball-receiving recess of the shuttle rotor, wherein a pair of launch tubes may be aligned with sectors neighboring opposite sides of the aforementioned sector in which the first ball-receiving station is positioned. More particularly, said at least one launch tube and said ball-receiving stations may be aligned with an upper half of the shuttle rotor, whereas the ball-reject station may be aligned with a lower half of the shuttle rotor.

According to a preferred aspect, the ball launcher may be configured for launching the ball from outside into the playing area into different launching directions by means of pressurized air that can be directed into different directions. According to an advantageous aspect, the ball launcher comprises a pair of launch tubes adapted to be connected to the airflow generator and defining different launching directions, wherein the ball gate for gating (i.e. to channel) the ball into one of the launch tubes includes a ball shuttle adapted to be moveable from a ball-receiving station to each one of said pair of launch tubes to transport the ball from the ball-receiving station to one of said launch tubes. Contrary to a ball rolling and finding its way into the launch tube by itself, the ball shuttle allows for actively moving the ball to the respective launch tube, thus providing for precise launch timing. The ball-receiving station may be positioned between said pair of launch tubes so as to provide for a short shuttle path to both launch tubes, thereby achieving efficient and quick shuttle operation.

The ball launcher may comprise more than two launch tubes which may define more than two different launching directions, wherein three or four or five or even more launch tubes may be serviced by a common ball shuttle which may stop at each of said launching tubes to hand over the ball to be launched through the respective launch tube from outside into the playing area.

The launch tubes may have openings which are positioned spaced apart from each other along said circular path of the ball-receiving seat of the shuttle rotor about the rotor axis. Thus, the shuttle rotor may be rotated to bring the ball-receiving seat into registration with one of the launch tubes.

Said shuttle rotor may be rotatorily driven by a stepper motor which precisely may rotate the shuttle rotor to stop at desired positions, in particular at the ball-receiving station and each of the transfer stations where the ball is transferred from the shuttle to the respective launch tube. Basically, instead of such stepper motor, other drive means might be provided, for example in combination with mechanical stopping means against which the shuttle can be driven to stop at the desired position. Nevertheless, the aforementioned stepper motor may be advantageous with regard to wear and tear.

Said ball-receiving seat of the ball shuttle may have various shapes and forms, wherein it may be open to one side to receive a ball from a predertermined receiving direction and may include a pair of engagement contures extending transverse to the shuttle-moving path to force the ball from the receiving station to the respective launch tube. Furthermore, the receiving seat may have at least one open side to allow the ball to go into the launch tube. More preferably, the aforementioned ball-receiving seat may be formed by a through hole which may be brought into registration (coincidence, alignment) with the respective launch tube so that pressurized air may be injected into said through hole from one side to force the ball to leave into the launch tube on the other side. In addition or in the alternative, the through hole may have an open radial side and/or a radial opening and/or be formed as a slot-like longitudinal hole open to one longitudinal end to allow for receiving a ball in a direction transverse to the longitudinal axis of the hole.

According to another aspect, the ball shuttle may not only transport the ball from the receiving station to the launch tube, but also may influence the airflow from the airflow generator and the launch tube, thus fulfilling a double function. More particularly, the valve shuttle may form a valve which may at least partly close one of the launch tubes when launching a ball through another launch tube to avoid pressure losses via the non-used launch tube. In particular, the ball shuttle may include, in addition to the ball-receiving seat, a valve portion which is moved to the non-used launch tube to close such launch tube at least partly when the valve seat is moved to the other launch tube.

To combine the valve function with the ball transport function in a space-saving way providing for easy kinematics, the ball shuttle may be formed as a moveable, preferably rotatable valve plate including a through hole forming the ball-receiving seat for receiving the ball, wherein the launch tubes may have endings facing said valve plate at a path along which the through hole is moveable. Thus, the valve plate, when moving transverse to the longitudinal direction of the launch tubes, may close the launch tubes except when the through hole comes into registration with one of the launch tubes.

To allow continuous working of the airflow generator, a discharge valve may be provided for discharging pressurized air during phases when none of the launch tubes is open or used, wherein such discharge valve also may be incorporated into the ball shuttle and in particular into the valve plate formed by such ball shuttle. The valve plate may include a discharge opening that may connect the airflow generator to a discharge opening when the valve plate is in positions where the ball-receiving through hole is not in registration with any one of the launch tubes. Preferably, such discharge opening may be disconnected from the air generator when the valve plate is moved into a position where the ball-receiving through hole comes into registration with one of the launch tubes, thereby avoiding pressure losses via the discharge opening and increasing the airflow efficiency through the launch tube through which the ball is to be launched.

The aforementioned launch tubes may extend from opposite sides of the ball shuttle to define launching directions opposite to each other.

When there are two or more launch tubes, there may be two or more airflow generators, wherein each launch tube may have its own airflow generator. The ball shuttle may be used to control the airflow mass and/or airflow speed and/or airflow pressure in each tube, for example by means of varying the opening area of each launch tube as described and/or bypassing airflow coming from the respective airflow generator. In the alternative, the airflow generators may be adapted to provide for variable airflow mass and/or variable airflow speed and/or variable airflow pressure, wherein said airflow generators may be controlled by said airflow controller in response to ball speed detected by at least one ball speed detection device in the used launch tube or in said playing area. In particular, countercurrent airflow may be introduced by airflow through a launch tube not used for the ball.

According to another aspect, the ball launcher may include at least one launch tube having a non-circular cross-section that gives spin to the ball when the ball is moved through the launch tube. Such non-circular cross-section may provide for an asymmetrical engagement between the ball and the circumferential wall of the launch tube, thereby causing the ball to spin about a spin axis going through the ball.

The cross-section of the launch tube may be differently contured. For example, it may have a polygonal cross-section such as a rhomp-shaped or lozenge cross-section. More particularly, the launch tube may have a oval or elliptical cross-section so that the ball may contact opposite sides of such conture at ball surface points lying on the same half of the ball, thereby creating spin of the ball. The ball may contact the oval or elliptic conture at a portion thereof where the radius of curvature is going towards a minimum, wherein the ball's diameter may be larger than the width of such oval or elliptic portion so that the ball is contacted below its horizontal middle plane.

More generally, said non-circular cross-sectional conture of the launch tube may form a continuos and/or continuosly concave surface and/or is formed by an enveloping surface of an inner contour of said launch tube. Such enveloping inner surface of the tube is non-circular and forms the contact contour where the ball may contact the tube. In particular, the surface may be free of recesses, grooves, steps or other incontinuities in the cross-section, and thus may form a smooth contact surface supporting the ball.

The tube may have a substantially constant wall thickness when considering a crossection of the tube or each crossection thereof or when considering the entire tube.

Depending on the desired orientation of the ball spin, the non-circular conture may have different orientations. For example, the non-circular cross-sectional conture of the launch tube may have a main cross-sectional axis extending in an upright direction to give the ball a forward spin wherein such main axis may be the longer one of the two main axes of an oval or elliptical conture. When the ball exits the launch tube with forward spin, it will cause less friction than with counter spin. Therefore, wear and tear and abrasion of the ball material and/or the gaming area surface may be reduced.

In addition to controlling spin of the ball more reliably, a non-circular cross-section of the launch tube may achieve more consistent speed as oscillation of the ball transverse to the longitudinal axis of the launch tube can be avoided. Such oscillation of the ball occurring in a conventional launch tube of a circular cross-sectional shape may result in drastically lower ball exit speed and thus, in an invalid ball shot.

The non-cross-sectional shape of the launch tube may be produced by deformation of a tube initially having a circular cross-section. For instance, a number of u-shaped clips or profiles may be attached to the outside of the launch tube to produce such oval or elliptical tube shape in very simple manner. The width of the u-shaped clips may define the non-circular cross-sectional shape of such constrained launch tube.

Due to such non-circular shape of the launch tube, no separate spinning devices (to give the ball a spin) are necessary, such as rotatably-driven wheels spaced apart from each other and defining a gap through which the ball is forced by rotation of said wheels. Nevertheless, such separate spinning device may be used in addition.

In order to achieve a simple design and construction, the ball launcher may dispense with such separate spinning devices and the launch tube may provide for a continuous, obstacle-free non-stop path for the entire way of the ball from the ball gate and the ball shuttle, respectively, to the playing area of the gaming system and the entrance thereof.

In order to achieve a quick recovery of a ball leaving the playing area after a playing round has been finished according to another aspect, the ball launcher may have a feeding tube for feeding a ball from the playing area to the ball gate, said feeding tube having an inlet to be associated with a discharge opening of the playing area, wherein said feeding tube may define a substantially vertical ball path from the playing area's discharge opening to the ball gate of the ball launcher to allow the ball to directly fall from the playing area into the ball gate of the ball launcher.

In other words, the ball may be dropped directly from the playing area to the shootout position in almost vertical path. By this measure, the ball is moved in comparatively fast way from a point/position where it is visible to the player to the point/position where the ball is ready to shootout without any additional mechanism or pushing of the ball. This approach allows for a single ball gaming, in particular roulette system (i.e. only one ball is in the system) to keep the single ball on the playing area until just moments before the shootout, hence further enhancing trust into the roulette gaming system.

Discharging the ball from the playing field after a gaming round has been finished, may be achieved in different ways. For example, when the gaming system is a roulette gaming system comprising a rotatable roulette wheel having a plurality of ball-receiving pockets and located in a wheel bowl, said pockets of the roulette wheel may have no bottoms and a ball-supporting surface may be provided underneath the roulette wheel. When the ball has landed in one of the pockets, the roulette wheel may be rotated to a predetermined position and/or the supporting surface underneath the roulette wheel may be moved and/oder configured to provide an opening at such predetermined position where the pocket with the ball has been rotated to. More generally, the ball-supporting surface underneath the roulette wheel may include a moveable member coplanar with the surrounding supporting surface and arranged for selective movement between a first position where the moveable member will support the ball located in the pocket and a second position where the moveable member will not support the ball located in the pocket.

Another option for discharging the ball from the playing field is adjustment of a center piece of the roulette wheel in height. More particularly, an inner portion of the roulette wheel adjacent to the pocket ring and forming an inner barrier preventing the ball lying in one of the pockets from rolling out of the pocket, may be elevated so that the pockets get rid of the aforementioned inner barrier and a ball received in one of the pockets may roll down and drop into the inlet of the feeding tube to fall down to the shootout position. Before said inner portion of the roulette wheel is elevated, the roulette wheel has been rotated to the predetermined position where the respective pocket in which a ball has landed is positioned above the inlet of the feeding tube of the ball launcher, as described before.

In the alternative, the pockets themselves may be provided with a bottom that can be opened, for example in terms of a flap or trap door to discharge the ball from the spinning wheel to the ball launcher which may be positioned immediately beneath the spinning wheel.

The gaming system may include a sensor device for determining the pocket in which a ball landed so that a roulette wheel controller may rotate the roulette wheel to register the determined pocket with the discharge station and the ball launcher's feeding tube inlet.

According to a preferred embodiment, a high resolution encoder for determining the position of the roulette wheel comprising the (numbered) compartments may be provided. The high resolution encoder may provide more signals per revolution of the wheel than the number of pockets is, and allows for higher precision which helps with smoother spinning at lower speeds, smoother PID regulation, stopping of the wheel at exact position.

In a preferred embodiment the encoder(s) has a resolution of more than 38 steps taking into account the usual number of pockets of a roulette wheel. By such measures accurate stopping and positioning of the wheel for the direct drop is possible, and it provides less stress for mechanical components and more reliable operation of the roulette wheel.

According to another aspect, the airflow generator may be adapted to provide for variable airflow mass and/or variable airflow speed and/or variable airflow pressure, wherein said airflow generator may be controlled by an airflow controller in response to ball speed detected by at least one ball speed detection device in said at least one launch tube or in said playing area. Such variable control of the airflow may be used to vary the ball speed to further randomise the gaming results. It also may be used for compensation of wear and tear of the airflow generator or contamination and pollution of the airflow generator and its attachments such as an air filter getting clogged.

The aforementioned ball speed detection device may include speed sensors directly measuring ball speed, for example radar sensing devices. In the alternative or in addition, the ball speed detection device may include at least two ball sensors spaced apart from each other along the ball path through the launch tube and/or in the playing area, such ball sensors giving ball detection signals at different points of time corresponding to the distance of the ball sensors and the ball speed. As the distance of the ball sensors is known, a speed calculator may calculate ball speed from the time difference between signals of said ball sensors.

Such at least two sensors or other elements of the speed detection device such as the aforementioned radar sensor may be positioned at the exit of the launch tube and/or the entrance of the ball into the playing area and/or in the vicinities thereof so as to detect or determine the speed of the ball entering into the gaming area. In addition or in the alternative, the speed detection device may be positioned or may include sensors positioned at other sections of the launch tube and/or at other sections of the gaming area such as the outer rim defining the bank path of a roulette gaming device.

In response to the determined speed of the launched ball, a variety of parameters may be adjusted, for example airflow, air pressure, air flow direction, timing of the injection of air, rotational speed of a blower creating the airflow and/or position or operational status of a valve device that may influence airflow. For example, airflow and/or air pressure during the launch process, i.e. when the ball goes through the launch tube, can be adjusted to a achieved desired ball speed. In the alternative or in addition, airflow and/or air pressure and/or timing thereof may be adjusted after the ball has entered into the playing area. For example, the launch tubes may be used to inject air onto the outer portion of the playing area of a roulette game so that such injected air may influence spinning and/or speed of the ball rolling along the bank path of the roulette bowl. For example, when injection of air is continued through the launch tube through which the ball was launched, speed of the ball may be increased or at least maintained as the injected air goes along the bank path in the same direction as the ball rolls and thus, the injected air may push the ball from behind. On the other hand, if a launch tube going into the opposite direction (in comparison to the launch tube through which the ball was launched) is used to inject air, the ball rolling along the bank path may be decelerated and/or given a counter spin.

So as to influence ball speed and/or spinning thereof after the ball has been launched onto the playing area, air may not only be injected through the aforementioned launch tubes, but through additional air injection tubes which may not be used for ball launching. For example, additional air injection tubes may end in the vicinity of the bank path and/or via the canoes forming obstacles in the upper portion of the roulette wheel.

Thus, after successful launch of the ball additional air may be injected through any existing holes and/or the launch tubes. Throughout the game any of the tubes might be used irrespectively of the launch direction to influence the airflow in the playing area.

If the speed of the ball when it enters the playing area is below minimal required speed, system can use airflow in the direction of the ball to salvage the game, thus, reducing the number of invalid shots. Same technique can be used to enforce minimal number of circles.

Airflow in the direction of the ball spinning can be achieved by injecting air through the tube that launched the ball.

Airflow in the opposite direction of the ball spinning can be achieved by injecting air through the tube which did not launch the ball.

Similar effects can be achieved with air suction. Air suction is, however, not as efficient as air injection.

Thus, ball speed may be controlled by means of adjusting the strength of the airflow and/or the airflow direction. In particular, so as to decrease speed of a ball, airflow may be reversed and/or airflow in the direction opposite to the ball moving direction may be injected. On the other hand, so as to increase ball speed, airflow going the same direction as the ball moving direction may be increased or additionally injected.

Airflow changes also may be achieved by pivoting/swiveling/moving the ball shuttle from an exhaust position to any of the launch tubes positions or from any of the launch tubes positions to exhaust position or portions in between.

Adjustments of the air throughput by only partially opening the desired holes (i.e. launch tubes or exhaust) is possible by adequate control of the position of the ball shuttle or the valve plate thereof, in particular control of the angular position of the shuttle rotor. In other words, the shuttle rotor positions allow airflow with all airflow to the first or second launch tube or all flow to the exhaust or there may be various degrees of partially opened exhaust and one of the first or second launch tubes in between.

The blower of the airflow generated for instance may be a mechanical component that has certain momentum and needs some time to develop the full power. In a preferred embodiment a separate exhaust allows prestart of the blower while the ball is waiting (until shoout out signal) or is still entering the ball shooter hence preparation time until the next game is reduced.

By such measures faster ball launch, faster airflow adjustments, reverse airflow, reduced costs, higher availability and shorter game cycles, may be achieved.

More than one sensor may be used to detect the ball on the exit of the launch tube. Multiple sensors at the exit of a launch tube are provided for measuring of the ball speed just before leaving the launch tube. This allows detection of bad shots before the ball is visible on the roulette wheel. The system can then determine if the shot is void and in case of immediately declare invalid game.

The speed of the ball at the exit of the launch tube may also be used to calculate the properties of the system.

Measuring the ball speed at the exit of the launch tube is a significant improvement over measuring the time needed for the ball launch (time from beginning to end of launch path) since the ball oscillation or other launch problem may happen anywhere on the launch path (e.g. if it happens at the end, the time is still acceptable while the speed is well below the target). The measured ball speed more precisely describes the status of the ball. Therefore, two sensors may be positioned close to each other in the vicinity of or at the launch tube exit.

Using two or more sensors also gives the system capability to fall back to basic operation in case of one sensor malfunction.

Ball speed may be measured based on time events of appropriate sensors detecting passing by of the ball. Photo sensors may be provided for detecting the ball and providing the time events. The sensors may be arranged at appropriate distance between each other along the ball path.

Once the ball is launched to the roulette cylinder, at least one sensor, preferably more than one sensor, is used to detect the ball on the rim of the cylinder. Multiple sensors on the rim allow multiple measurements per one spin (i.e. where the ball travels on the rim for one circle) which are then used to better evaluate the acceleration/deceleration of the ball. Using two or more sensors also gives the system the capability to fall back to basic operation in case of one sensor malfunction.

According to a further preferred embodiment, time measurements during the ball launch and/or during spinning of the ball in the cylinder may be performed and results of which may be provided to adjust the power of the blower if needed. The time measurements may be used to regulate blower power based on expected and actual times. Also mechanical malfunctions (like damaged path and bad/invalid ball shots) may thus be discovered.

The time measurements may be collected during the game or with specially triggered calibration shots. Since the measurements may be done during the actual game without influencing the result there is no downtime and that increases the availability of the machine. Adjustments of the blower power may be already used for the next shoot without any downtime or intervention from service personnel.

Pre-failure warnings can be issued when adjusted blower power is nearing the max power (e.g. dirty air filter or mechanical wearing).

In other words, ball triggered time measurement may be used to automatically recommend (e.g. in maintenance mode/administration) or adjust blower settings. The recommendations and auto adjustments significantly simplify the maintenance of the machine. This provides for easier use, less maintenance, increased availability, longer operation in the optimal performance range, pre-failure warnings, reduced cost of ownership, longer lifetime of the product.

In a preferred embodiment full auto calibration may be done on demand, at initial startup or in case if quick auto calibration failed. Full calibration cycle may comprise a series of many individual ball shoots. Quick auto calibration/verification may be done on each startup of a server controlling the roulette system. Quick calibration may comprise only few individual ball shoots to verify if the last values are still valid. If the verification fails a full calibration may be started.

According to a preferred embodiment the cylinder is covered in a way that it closes the air within the cylinder and creates a kind of air chamber which prevents air to escape in unpredictable ways. Such a cover may be in the form of a lid, preferably minimizing airflow in direction normal to the roulette wheel plane. The air chamber does not need to be air tight. Air chamber in combination with air injection forces the air to start flowing in the circular way, increasing and prolonging the effect of airflow control.

BRIEF DESCRIPTION OF THE DRAWINGS

In the following, the present invention is described in further detail on the basis of preferred embodiments in connection with corresponding drawings. In the drawings show.

DESCRIPTION OF EMBODIMENTS

Figure 1:
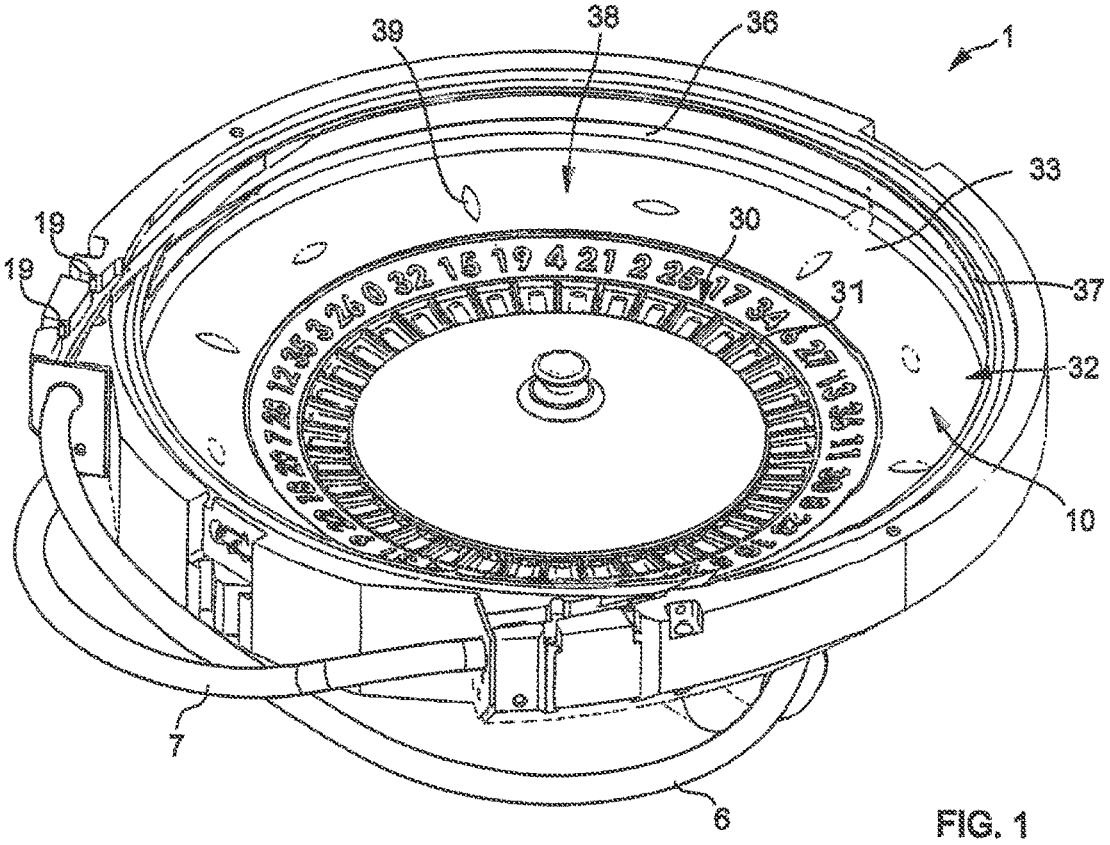
FIG. 1: a schematic view of a roulette gaming system comprising a ball in which a rotatable roulette wheel is provided, wherein two ball launch tubes for launching the ball into the bowl into opposite directions are shown.

As can be seen from FIG. 1-4, a ball game device 1 may be adapted to play the game of roulette. A gaming area 10 of the ball game device 1 may include a spinning wheel 30 which may be provided with a ring of pockets 31 or landings in which a ball launched into the gaming area 10 may stop. As well-known from roulette games, such pockets 31 or landings may be associated with numbers so that the number of the pocket 31 where the ball stops is the winning number.

The spinning wheel 30 is received in a bowl 32 having a rolling area 33 (cylinder) in which a ball rolls in a random number determination phase and a support rack (not illustrated) that supports the bowl 32 of the roulette game device. The spinning wheel 30 and the surrounding rolling area 33 together form the roulette wheel 38 which is the playing area 10. Preferably the roulette wheel 38 is placed horizontally, where the roulette wheel axis is plumb.

The roulette wheel 38 includes a frame body that is fixed at the support rack, wherein said spinning wheel 30 is rotatably held and supported, by one or more bearings, inside a frame body. The spinning wheel 30 may be caused to rotate in a predetermined direction with respect to the frame body (for example, in a clockwise direction) and at a predetermined speed by a drive motor (not illustrated) provided inside the roulette device. The drive motor, and where present, a drive mechanism or transmission, operate under the control of a control system 35 to rotate the spinning wheel 30 in a selected direction at a selected speed.

The rolling area 33 where the ball actually rolls on the roulette wheel may comprise a single inclined face with a predetermined angle (for example, 15 degrees) formed by a first inclined face that is formed at an outer circumferential edge side of the frame body. The inclined face is inclined upward along the direction from the center to the circumference of the roulette wheel 38.

A bank path 36 is provided at an outer circumferential edge portion of the bowl 32. A first launch tube 6 is arranged to let the ball launch to the bank path 36 in a first launch direction. A second launch tube 7 is arranged to let the ball launch to the bank path 36 in a second launch direction, opposite to the first launch direction. The bank path 36 guides the ball 4 against centrifugal force of the ball rolling on the roulette wheel 38 and is a path that causes the ball to roll so as to follow a circular track. In addition, the bank path 36 is formed in an endless fashion with respect to the roulette wheel 38 by way of a guiding wall 37 which is installed upright in a vertical direction. An upper wall portion may be formed to be continuous with the bank path at an upper edge, which is an outer circumferential portion thereof. The upper wall portion is a member that biases the ball revolving on the bank path inwardly so as not to jump to the outside of the roulette wheel.

As the revolution speed of the ball that has been injected to the bank path 36 decreases gradually and loses centrifugal force, the ball rolls and falls along the inclination of the inclined face toward the inside of the roulette wheel 38 and reaches the spinning wheel 30, which is rotating. Then, the ball falls in any one of the pockets 31 that is formed on the wheel. Thus, a winning number is determined by the roulette device. A number of obstacles or canoes 39 (e.g with rhombus-shaped base) may be provided and arranged on the inclined face to form barriers on which the ball is deflected in random directions by collision, further enhancing the randomness.

The period between the roulette ball being launched into the bank path 36 (ball travels around the upper outer edge of the inwardly sloping rolling area) and the roulette ball beginning its descent towards the wheel is commonly referred to as the spin cycle. The point when the roulette ball begins its descent towards the wheel is commonly referred to as the drop.

The ball game device may be provided with a launching mechanism or ball launcher 3 for launching the ball semi-automatically from outside into the gaming area.

A ball position sensor may be provided to determine the position of the ball in a pocket of the spinning wheel 30, and to provide signals identifying this position to the control system 35. The control system 35 uses these position signals to determine when the ball has come to rest and to identify which one of the landings 31 the ball has come to rest and been retained in. As is well known, in the game of roulette players place various bets which are based on which of the slot compartments the roulette ball is finally retained in, i.e which random number has been determined by the random process of ball spin and drop.

Then, after the pocket 31 in which the ball is retained has been determined, a ball recovery mechanism operates under the control of a control system to remove the ball from the pocket and return it to the ball launching mechanism so that it can be launched again in a later game of roulette.

Figure 2:
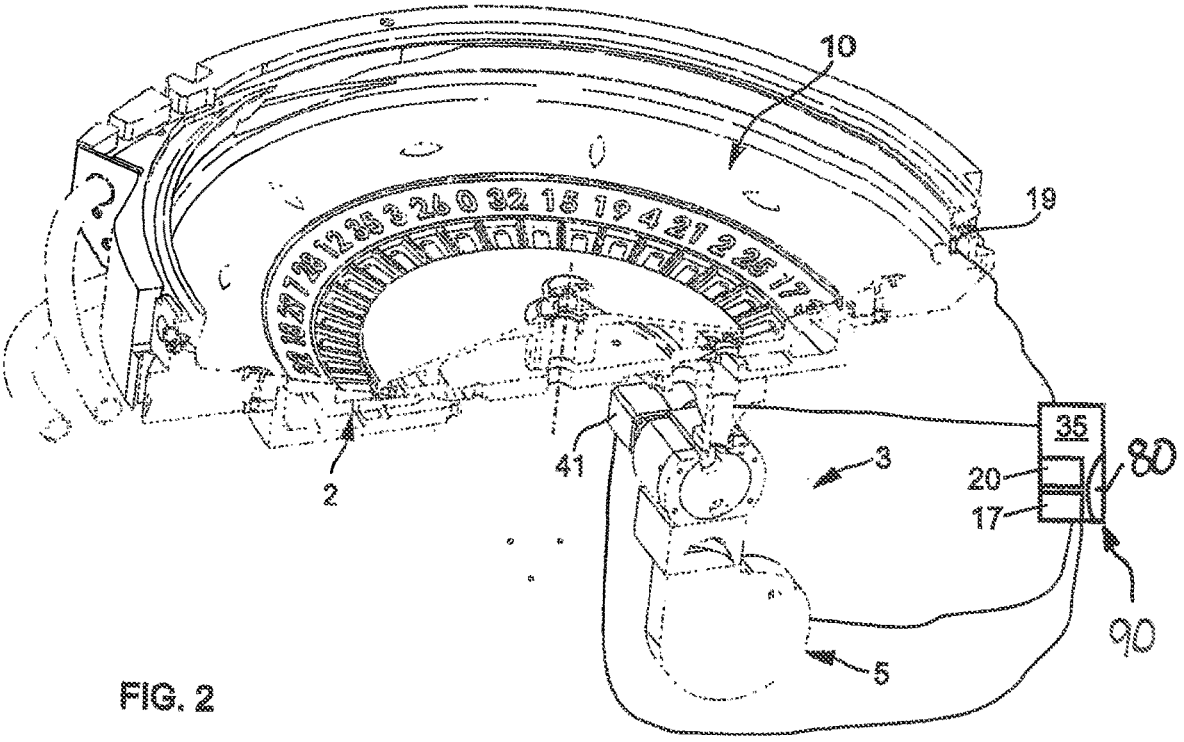
FIG. 2: a perspective, partially cross-sectional view of the roulette gaming system of FIG. 1, wherein the ball launcher positioned beneath the roulette wheel is shown.
Figure 3:
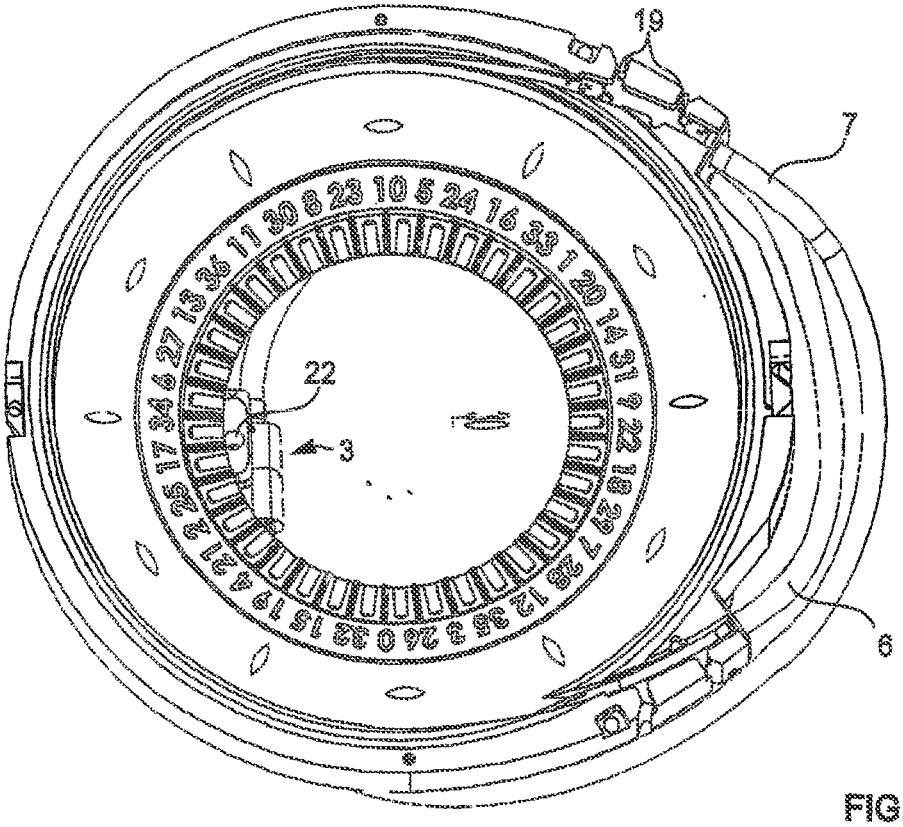
FIG. 3: a top view onto the roulette gaming system of the preceding figures.
Figure 4:
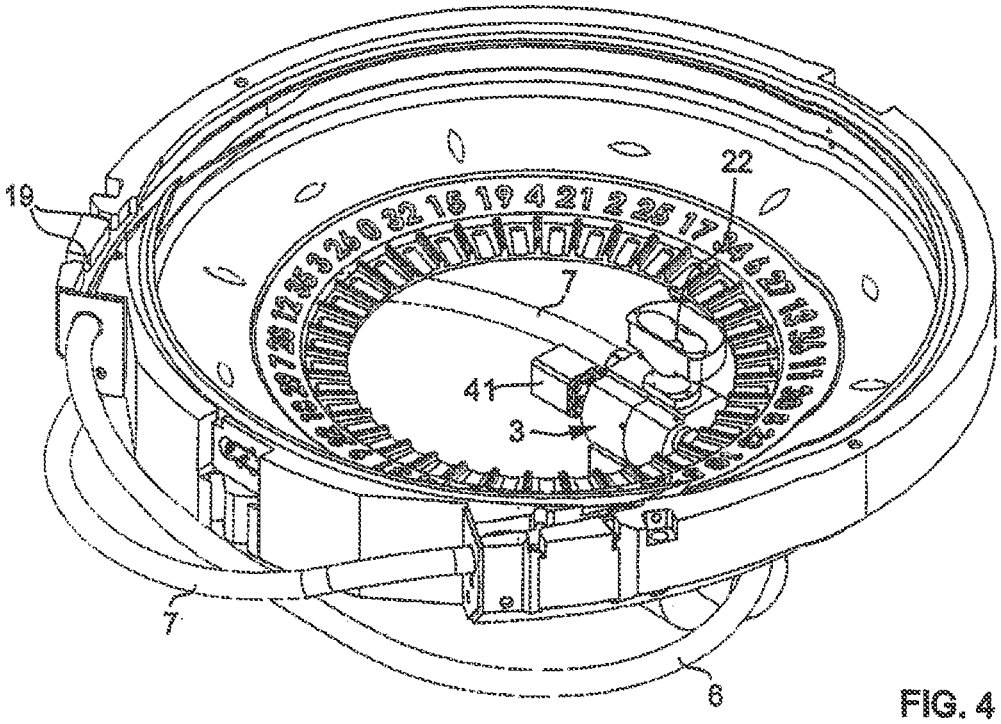
FIG. 4: a perspective view onto the roulette gaming system similar to FIG. 1, wherein the center of the roulette wheel is shown transparent to allow a view onto the ball launcher beneath the roulette wheel and the positioning thereof.

As can be seen particularly from FIGS. 2 and 4, the ball launcher 3 may be positioned directly beneath the spinning wheel 30 to receive the ball discharged from the respective pocket 31. The pocket 31 in which the ball has landed, may be identified by means of a respective detection device which may include ball sensors associated with the pockets 31. In response to the identification of the pockets 31, the spinning wheel 30 may be rotated under control of the control system to bring the pocket 31 into which the ball has landed into registration with the ball launcher, more particularly into a position directly above the ball launcher 3. More particularly, the ball launcher 3 may include a feeding tube which substantially extends vertically (parallel to the axis of the roulette wheel 38) and has an inlet formed by the upper end of said feeding tube positioned directly beneath the spinning wheel 30. The said feeding tube inlet may have an increased diameter and/or a sort of enlarged collar to allow for some unpreciseness of the position of the pocket from which the ball should be discharged, relative to the feeding tube. To discharge the ball from the pocket 31 into the feeding tube, an inner portion of the roulette wheel 38 may be elevated so that the ball may roll out of the pocket 31. Adjusting said inner portion of the roulette wheel 38 in height may open the inner side of the pockets 31 and thus, a ball discharge opening 23 of gaming area 10.

Figure 5:
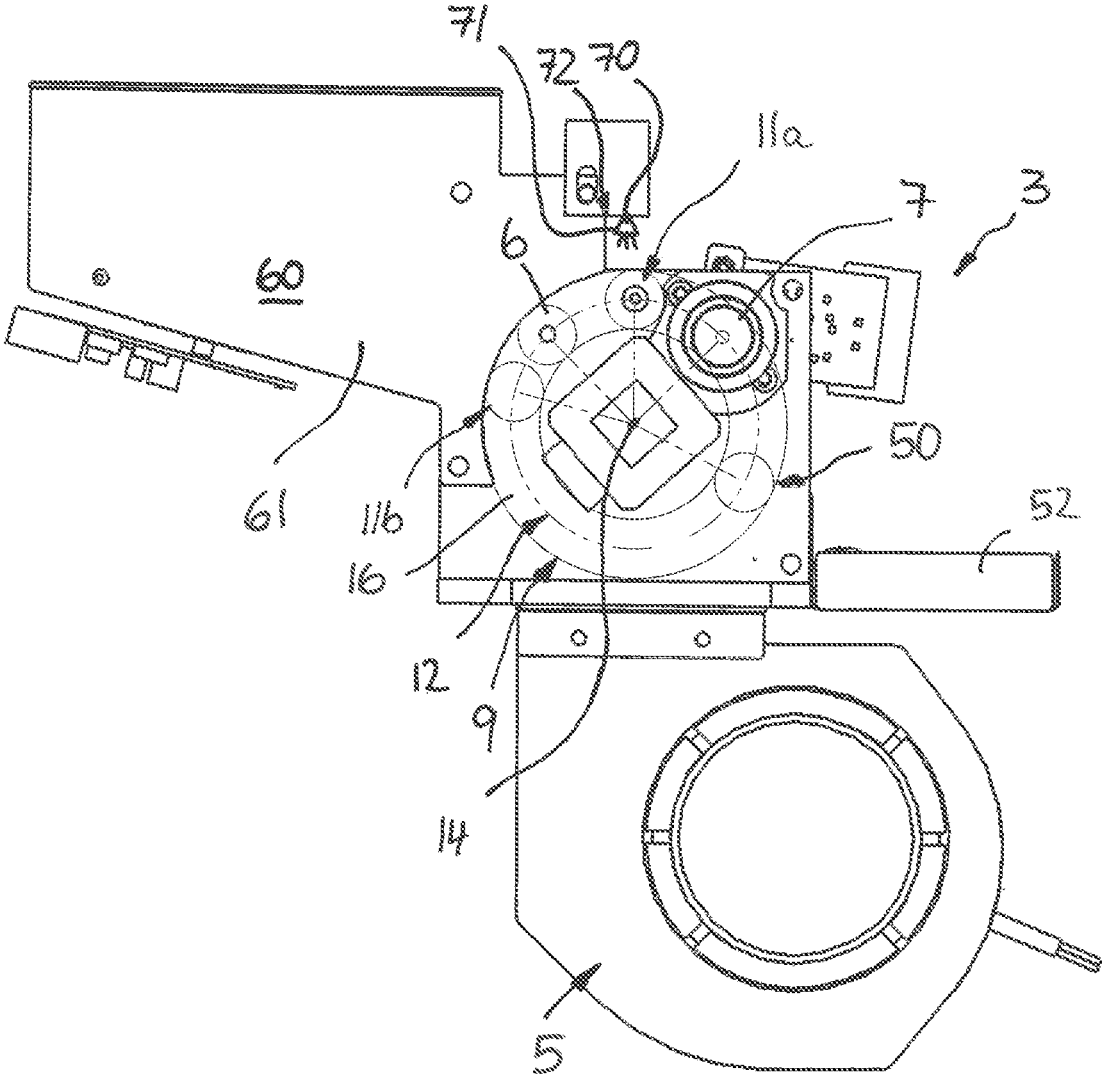
FIG. 5: a schematic side view of the ball launcher of the gaming system, wherein the blower and the combined ball gate and valve shuttle with the launch tubes and ball storage connected thereto are shown, wherein the shuttle rotor's various stopping positions are shown.
Figure 6:
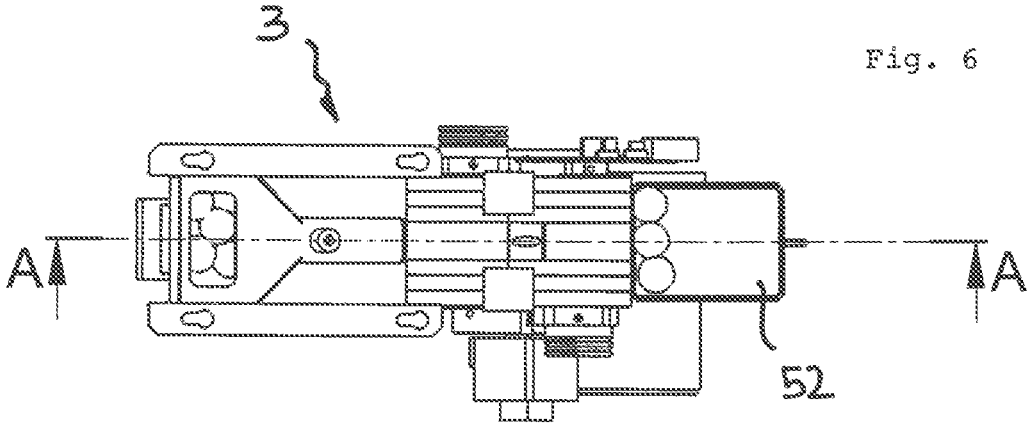
FIG. 6: a top view of the ball launcher of FIG. 5, wherein the ball storage and the reject-ball station are shown on opposite sides of the ball landing.
Figure 7:
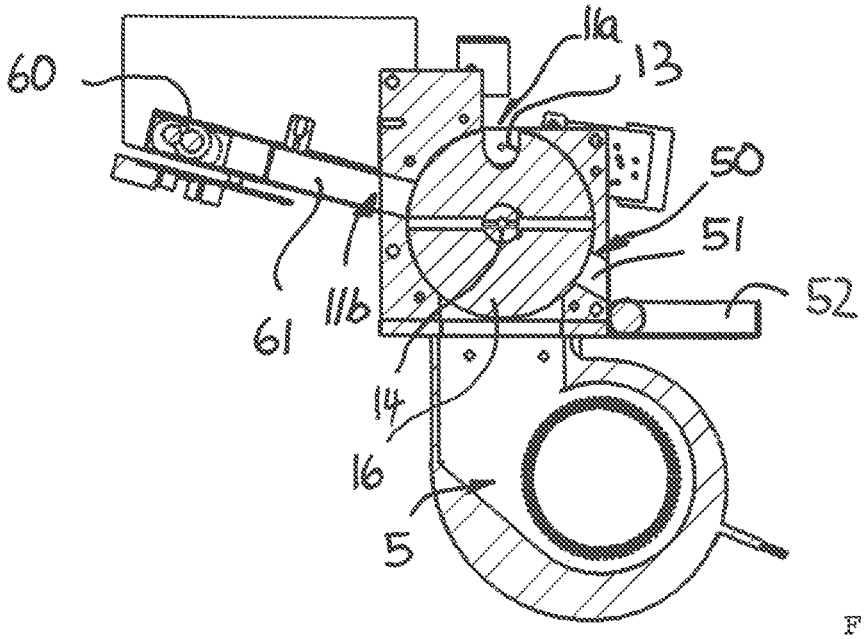
FIG. 7: a cross-sectional view of the ball launcher along line A-A in FIG. 6, where the valve's rotor plate is shown in a rotatory position where the ball-receiving seat is registered with the first ball-receiving station.

As can be seen from FIGS. 5 to 7, the lower end of said vertical feeding tube may lead to and/or may be controlled by a ball gate. More particularly, the lower end of said vertical feeding tube is associated with a ball shuttle 9 which has a ball-receiving seat 13 to receive the vertically dropping ball coming from the roulette wheel 38 through the feeding tube, cf. FIG. 7 showing the ball shuttle 9 with its ball-receiving seat 13 being positioned at the first ball-receiving station 11*a* where the ball coming from feeding tube may drop into said ball-receiving seat 13.

The ball-receiving seat 13 may be formed by a cavity in the body of said ball shuttle 9, wherein such cavity may be formed as a through hole having an additional open side to the outer periphery of the body of the ball shuttle 9.

More particularly, said ball shuttle 9 may be formed as a shuttle rotor 12 that can be rotatorily driven by a shuttle motor 41, which can be a stepper motor. More particularly, the shuttle rotor 12 may be formed as a shuttle plate 16 which may be received within a ball launcher housing and/or rotatably supported on a structural part of the ball launcher 3 about a substantially horizontal axis. It nevertheless should be mentioned that the shuttle rotor axis 14 about which the shuttle rotor may pivot may also extend vertically or at inclinations between vertical and horizontal. However, the shown horizontal shuttle rotor axis 14 is advantageous for launching the ball into opposite directions from said shuttle rotor 12.

The aforementioned ball-receiving seat 13 may be formed by a slot-like recess open to the circumferential side of the shuttle plate 16 and also forming a through hole, i.e. open to opposite main surfaces of the shuttle plate 16. The opening to the circumferential side allows for receiving the ball from above through the feeding tube when the shuttle rotor 12 is in the ball-receiving position where the aforementioned recess is positioned at about 12 o'clock below the feeding tube. The through hole openings to the main surfaces of the shuttle rotor plate 16 allow for launching the ball for into either one of the launch tubes 6, 7 leading away from opposite sides of the shuttle rotor 12. The shuttle plate 16 may be regarded in an embodiment as a cylindrical body with a circumferential side and a first end face and a second end face, the two end faces standing normal to the cylinder axis 14 and opposing each other.

As can be seen from particularly FIG. 5, said launch tubes 6, 7 include endings which are positioned at a circle around the shuttle rotor axis 14, wherein such circle corresponds to the circular path of the ball-receiving seat 13 when the shuttle rotor 12 is rotated respectively rotationally placed in certain position. Advantageously, the launch tubes 6, 7 are positioned/arranged on opposite sides of the shuttle rotor 12, particularly an ending of the first launch tube 6 directed to the first end face and an ending of the second launch tube 7 directed to the second end face of the shuttle plate 16, at different sectors thereof with the feeding tube or the ball-receiving station 11 being positioned therebetween. For example, the first ball-receiving station 11*a* can be positioned at about 12 o'clock, whereas the first launch tube 6 (i.e. the end of the launch tube into which the ball is blown) may be positioned somewhere between a ten (10) and eleven (11) o'clock position and the second launch tube 7 may be positioned between a one (1) o'clock and three (3) o'clock position. Thus, the rotatory distance from the first ball-receiving station 11*a* to the chosen launch tube 6 or 7 is very short, for instance less than a quarter turn of the shuttle rotor 12, and a fast launching process can be achieved.

However, when a ball coming from the gaming area to said first ball-receiving station 11*a* and picked up there by the ball shuttle 9 is no longer of sufficient quality due to, e.g., pollution and/or wear and tear, such ball is not transported to one of the launch tubes 6 and 7, but is transported to a reject-ball station 50 to separate said ball.

As can be seen from FIGS. 5 to 7, such reject-ball station 50 may include a discharge path 51 in terms of, e.g., a discharge channel provided in a housing part surrounding the shuttle rotor, wherein said discharge path 51 may have an entrance neighboring the shuttle rotor 12 so a ball to be discharged may be turned over from the shuttle rotor 12 to said discharge path 51. More particularly, said discharge path 51 may have an entrance immediately adjacent to the outer circumference of the shuttle rotor 12 so that a ball received in the ball-receiving seat 13 may exit the shuttle rotor via the circumferential side thereof to move onto the discharge path 51.

Advantageously, the reject-ball station 50 is aligned with a lower half of the shuttle rotor 12 so that a ball to be discharged may roll or move by gravity from the ball-receiving seat 13 onto said discharge path 51 when the shuttle rotor 12 is in a rotary position where the ball-receiving seat is aligned with said discharge path 51, cf. FIG. 7 in combination with FIG. 5.

Said discharge path 51 may be sloped and/or inclined vis-à-vis a horizontal line so that a ball may roll down onto said discharge path 51 by gravity to be stored on a discharge storage tray 52, cf. FIG. 7. Said discharge path 51, however, may also guide a separated ball to other areas or regions of the gaming device further away from the ball launcher.

When a ball has been discharged at the reject-ball station 50, the shuttle rotor 12 may further rotate back or forth to bring the ball-receiving seat 13 into a position aligned with a second ball-receiving station 11*b* where a new (another/different) ball may be supplied from a ball storage 60 onto the ball shuttle 9.

As can be seen from FIGS. 5, 6 and 7, such ball storage 60 may be positioned on a side of the shuttle rotor 12 opposite to the reject-ball station 50. More particularly, said ball storage 60 and/or said second ball-receiving station 11*b* may be aligned with an upper half of the shuttle rotor 12 to allow a ball to be supplied from said ball storage 60 onto the shuttle rotor 12 by means of gravity. More particularly, the ball storage 60 may include a supply path 61 which is sloped or inclined vis-à-vis the horizontal line towards the second ball-receiving station 11*b* to allow a ball to roll or move into the ball-receiving recess 13 by means of gravity.

Said supply path 61 may have an opening aligned with said second ball-receiving station 11*b*. More particularly, said discharge opening of the supply path 61 of the ball storage 60 may be positioned immediately adjacent to a circumferential side of the shuttle rotor 12 so that a ball may roll from the supply path 61 onto the ball shuttle 9, more particularly into the ball-receiving seat 13 via the opening of said ball-receiving seat 13 to the circumferential side of the shuttle rotor 12. In other words, supply path 61 and discharge path 51 may be directed radially, i.e. normal to the shuttle rotor axis 14 in radial direction, while the endings of the respective launch tubes 6, 7 being directed to the shuttle rotor 12 may be parallel to the shuttle rotor axis 14.

Rotation of the shuttle rotor 12 is controlled by means of a control unit 90 which is responsive to a reject-ball signal. Particularly, when a "bad" ball needs to be sorted out and a reject-ball signal is given to said control unit 90, the motor 41 is controlled to rotate the shuttle rotor 12 with its ball-receiving seat 13 to be in line with the reject-ball station 50.

Such reject-ball signal may be input manually by a user via an input means 80. Such input means 80 may include a switch or a key or a touch-sensitive button on a control display. Thus, a user who sees a ball that is polluted or in other bad condition, may input a reject-ball signal to sort out such ball.

Furthermore, so as to allow for automatic recognition of bad quality of a ball, a ball quality detector 70 may be associated with the ball launcher 3. More particularly, said ball quality detector 70 may be positioned so as to detect a ball received in said ball-receiving seat 13 of the ball shuttle 9, wherein, more particularly, the ball quality detector 70 may be configured and positioned to detect a ball in said ball-receiving seat 13 when such ball-receiving seat 13 is aligned with the first ball-receiving station 11*a*, as it can be seen from FIG. 7.

Said ball quality detector 70 may include an imaging sensor 71 and/or a camera for optically detecting the ball and providing an image thereof. An image evaluator 72 may evaluate the image of said ball to determine the quality thereof. More particularly, said image evaluator 72 may be configured to determine in said image the outer contour of the detected ball and deviations of the outer contour from a circular contour, and/or may be configured to detect changes and/or deviations in color and/or in brightness in the image of the detected ball, and/or may be configured to detect a pixel pattern in said image of the detected ball to be compared to a predetermined pixel pattern.

If said image evaluator 72 determines deviations of the detected ball from a desired condition thereof, which deviations exceed a certain threshold, the ball quality detector 70 may issue the aforementioned reject-ball signal in response to which the shuttle rotor 12 with its ball-receiving seat 13 is moved to the reject-ball station 50 to discharge the ball.

Upon discharge of a ball at the reject-ball station 50, the control unit 90 may cause the shuttle rotor 12 with its ball-receiving seat 13 to the second ball-receiving station 11*b* so as to receive a new ball from the ball storage 60. Upon receipt of a new ball from the ball storage 60, the shuttle rotor 12 may be controlled to transport such new ball to one of the launch tubes 6 or 7.

As further shown by FIGS. 5 to 7, the ball launcher 3 further includes an airflow generator 5 which may include a blower that can be driven by a blower motor (not shown) which may operate under control of the control system 35.

The airflow generator 5 may produce airflow that may be directed through a forked airflow channel and a respective channel leading to a respective one of the launch tubes 6 and 7. However, it also would be possible to provide for two separate airflow generators 5 or separate blowers to produce separate airflows for the respective launch tubes 6 and 7.

Such airflow channels connecting the airflow generator 5 to the launch tubes 6, 7 may extend on the opposite side of the ball shuttle 9 and may end on the opposite side of said ball shuttle 9 so that airflow exiting the respective airflow channels go through the ball shuttle 9 before entering into the launch tubes 6 and 7. In other words, the ball shuttle 9 may be positioned in between the respective ends of the airflow channels and the respective ends of the launch tubes 6, 7. The respective end of the launch tubes 6 and 7 is preferably coaxially positioned with the end portion of the respective airflow channel so that airflow coming from the respective airflow channel may go directly and straightly into the respective launch tube 6 or 7.

The aforementioned shuttle rotor 12 may form a valve plate or control device for controlling the airflow through the launch tubes 6 and 7. More particularly, the shuttle rotor 12 may control the flow connection between said airflow channels and the launch tubes 6 and 7, wherein more particularly the flow connection depends on the rotatory position of the through hole forming the ball-receiving seat 13. When the shuttle rotor 12 is in its ball-receiving position, cf. FIG. 7, both launch tubes 6 and 7 may be disconnected from the airflow as the non-perforated portion of the shuttle plate 16 may block airflow coming from the airflow generator 5 from entering into the launch tubes 6 and 7. So as to nevertheless allow continuous operation of the airflow generator 5, the shuttle rotor 12 may be provided with a discharge opening which may be in connection with the airflow channels when the shuttle rotor 12 is in a non-launching position, such as the receiving-position shown in FIG. 7, and which is connected to an exhaust through which the air can be discharged to the environment.

In order to launch a ball through one of the launch tubes 6 or 7, the shuttle rotor 12 is rotated clockwise or counter-clockwise to bring the ball-receiving seat 13 into registration with one of the launch tubes 6 or 7.

Bringing the ball-receiving seat 13 into registration with one of the launch tubes 6 or 7 may, at the same time, open the flow connection between the airflow channels 24 to the respective launch tubes 6 or 7, as airflow may go through through hole.

When reaching such one of the launching positions, i.e. the ball-receiving seat 13 into registration with one of the launch tubes 6, 7, the entire airflow goes into the respective launch tube 6,7 and thus, launching becomes very effective.

When a ball is launched through one of the launch tubes 6, 7—which may have an oval or elliptical cross-section as described in more detail above—, a speed detection device may detect ball speed, preferably at the end portion and/or exit of the launch tubes 6 and 7 and/or along the bank path 36 of the roulette bowl. The ball speed detection device may include a plurality of ball sensors 19 positioned preferably in the vicinity of the respective exits of the launch tubes 6, 7 and/or in the launch tubes and/or along the aforementioned bank path 36, wherein the speed sensors may be spaced apart from each other at predetermined distances so that a speed calculator 20 may calculate ball speed from the time difference of the sensor signals. Such speed calculator 20 may be part of the control system 35 to which the ball sensors 19 are connected in a communicative way.

In response to determined ball speed, the control system 35 may adjust airflow, for example by means of adjusting current and/or voltage supply to the blower motor and/or adjusting the position of the ball shuttle 9, thereby adjusting airflow connection into the launch tubes 6 and 7. In a preferred embodiment the ball shuttle 9 is positioned such that the through hole of the ball-receiving seat 13 is only partially aligned with the respective launch tube. By this the cross-sectional area for the airflow may be continuously changed/adapted from zero to maximum (i.e. where the ball-receiving seat 13 is in registration with the respective launch tube).

To adjust the relevant parameters of airflow, the control system 35 may include an airflow controller 17 which may be responsive to ball speed.

According to an embodiment, the control system 35 may include a calibration and/or self-adaption component, which may calibrate and/or self-adapt the settings of the airflow generator 5 and/or of the ball shuttle 9 and/or of additional airflow components such as valves, so as to achieve a desired ball speed and/or a desired rolling path of the ball in the playing area 10. Such calibration may be effected prior to using the gaming system and/or self-calibration may be effected during gaming operation taking into account the detected parameters such as ball speed of a plurality of gaming rounds or launching processes.

Although the aforementioned ball launcher 3 has been described in combination with a roulette game, it may be used for launching balls into the playing areas of other types of games such as table football, wherein the feeding tube for feeding the ball from the playing area to the ball gate may be provided in the areas behind the goal-line, or a pinball machine where said feeding tube may be arranged in an area below the flipper arms.

In an embodiment the control system may provide signals to the betting apparatus indicating, or based upon, the timing of the launching of the ball into the roulette wheel 38. The betting apparatus may use these signals to determine when to stop taking new bets on a game of roulette from users. The stopping of taking new bets on a game of roulette is generally referred to as closing the game. A roulette game may be closed after the roulette ball has been launched into the roulette wheel bowl, during the spin cycle.

Each gaming terminal may be provided with a display device which may include a monitor, preferably in terms of a touch screen so as to display information relative to the ball game and/or information relative to placing bets and/or making predictions depending on whether the gaming system is playable with money or free of money.

In an embodiment, a display device may be provided and adapted to display a wagering field, sometimes referred to as the betting layout. Such wagering field may include a template which specifies a grid of numbers and betting options, wherein the numbers in the grid may correspond to the numbers in the pockets of the spinning wheel. Each graphical wagering layout enables a player to select desired numbers and betting combinations for their wagers. For example, a touch screen may allow for identifying a desired amount of credit by means of touching the respective coin symbol and, e.g., in a second step to place such amount of money on a specific number, e.g., by means of touching the respective number in the grid of numbers.

Furthermore, the display device also may be used so as to display further information such as, e.g., the time frame for placing bets which, e.g., may include the invitation "Game over—place your bet".

In addition to such input means, the input device, which may be implemented by the aforementioned touch screen, may include start signal input means which may be implemented by a respective display symbol on the aforementioned touch screen. Such start signal input means allows for inputting a start signal at the touch screen of the gaming terminal.

Although a gaming system in terms of a roulette game has been illustrated, the ball launcher may be used in other gaming systems such as table soccer.

The invention claimed is:

1. A ball launcher for launching a ball into a roulette playing area, comprising:

at least one launch tube, and a ball gate for gating the ball into the launch tube;

said ball gate includes a ball shuttle adapted to be moveable from at least one ball-receiving station to said at least one launch tube to transport the ball from the ball-receiving station to said at least one launch tube; and said ball shuttle is adapted to move to a reject ball station in response to a reject ball signal to transport any ball to be replaced to said reject-ball station instead of said at least one launch tube, wherein said ball shuttle is adapted to be movable to a first ball-receiving station for receiving a used ball coming from the playing area, and to a second ball-receiving station for receiving a new ball from a ball storage connectable to said second ball-receiving station, and wherein, in response to said reject ball signal, the ball shuttle is adapted to move from said first ball receiving station to said reject ball station to sort out said ball to be replaced, and to move from said reject ball station to said second ball receiving station for receiving a new ball from said ball storage, and to move from said second ball receiving station to said at least one launch tube to gate the new ball into said at least one launch tube.

2. The ball launcher as set forth in claim 1, further comprising:

a ball quality detector for detecting ball quality and issuing said reject ball signal upon detection of a ball having a quality selected from the group consisting of defective, polluted, unknown quality or combinations thereof.

3. The ball launcher as set forth in claim 2, wherein said ball quality detector includes an optical sensor for optically detecting a ball, and an image evaluator for evaluating an image of said ball provided by said optical sensor.

4. The ball launcher as set forth in claim 3, wherein said image evaluator is configured to determine in said image the outer contour of the detected ball and deviations of the outer contour from a circular contour, and/or configured to detect changes and/or deviations in color and/or in brightness in said image of said detected ball, and said image evaluator is configured to detect changes in color or brightness and pixel pattern in said image to be compared to a predetermined pixel pattern.

5. The ball launcher as set forth in claim 4, wherein said ball quality detector is configured to detect a ball positioned in at least one of: the playing area, the at least one ball-receiving station in said ball shuttle.

6. The ball launcher as set forth in claim 4, wherein user input means are provided for inputting said reject ball signal by a user.

7. The ball launcher as set forth in claim 1, wherein said ball shuttle includes a shuttle rotor having a ball-receiving seat and being rotatably supported about a shuttle rotor axis;

at least one of: said ball-receiving seat, an opening of said at least one launch tube, said at least one ball receiving station and said reject ball station are positioned on a circular path around said shuttle rotor axis.

8. The ball launcher as set forth in claim 7, wherein said shuttle rotor axis is horizontal, wherein said reject ball station is positioned in or below a horizontal plane containing said shuttle rotor axis, and wherein said at least one ball receiving station for receiving a new ball from a ball storage or a used ball from the playing area is positioned in or above said horizontal plane containing said shuttle rotor axis.

9. The ball launcher as set forth in claim 1, wherein said second ball receiving station and said ball storage are configured and arranged to drive a new ball from said ball storage into or onto said ball shuttle by gravity; said reject ball station is configured and arranged to drive a ball from said ball shuttle into said reject ball station by gravity.

10. The ball launcher as set forth in claim 9, further comprising an electric shuttle motor controllable by a control unit in response to said reject ball signal, wherein said electric shuttle motor is connected to said ball shuttle.

11. The ball launcher as set forth in claim 10, wherein said electric shuttle motor is a stepper motor controlled by said control unit, or said electric shuttle motor is controlled when the ball shuttle reaches a respective position aligned with one of said reject-ball station, said receiving station and said launch tube.

12. The ball launcher as set forth in claim 1, wherein an airflow generator for generating an airflow through said launch tube is connectable to a pair of launch tubes defining different launching directions, wherein said ball shuttle is adapted to be moveable from said at least one ball-receiving station between said pair of launch tubes to each of said pair of launch tubes to transport the ball from the ball-receiving station to one of said launch tubes, wherein said pair of launch tubes have openings each of which, together with said ball-receiving seat of the ball shuttle, is positioned on a preferably circular ball shuttle moving path.

13. The ball launcher as set forth in claim 12, wherein the airflow generated by said airflow generator is controlled by an airflow controller adapted to increase and/or decrease and/or reverse airflow and/or to cause airflow in a direction opposite to the ball moving direction, thereby increasing or decreasing ball speed and/or ball spin.

14. The ball launcher as set forth in claim 13, wherein said airflow controller is configured to control and/or reverse airflow in response to ball speed detected by at least one ball speed detection device in said at least one launch tube or in said playing area, wherein said ball speed detection device preferably includes at least two ball sensors spaced apart from each other along the ball path through the launch tube and/or in the playing area, and furthermore a speed calculator for calculating ball speed from the time difference between signals of said ball sensors.

15. The ball launcher as set forth in claim 13, wherein said airflow generator is adapted to provide for variable airflow mass, speed and airflow pressure, wherein said airflow generator is controlled by said airflow controller which is adapted to control the airflow generator in response to detected ball speed.

16. The ball launcher as set forth in claim 15, wherein said ball shuttle forms a valve adapted to partially and/or entirely open and close the at least one launch tube, wherein said airflow controller is adapted to control the position of the ball shuttle in response to detected ball speed, thereby controlling airflow mass and/or airflow speed and/or airflow pressure in said at least one launch tube.

17. The ball launcher as set forth in claim 13, wherein said at least one launch tube has a non-circular cross-sectional contour, more particularly oval or elliptical contour with a main cross-sectional axis extending upright, for giving spin to the ball along its way through the launch tube, said launch tube providing for an obstacle-free, non-stop passage for the ball from the ball gate into the playing area, wherein said non-circular cross-sectional contour of the launch tube forms a continuous and/or continuously concave surface and/or is formed by an enveloping surface of an inner contour of said launch tube.

18. The ball launcher as set forth in claim 17, further comprising a feeding tube for feeding a ball from the playing area to the ball gate, said feeding tube having an inlet to be positioned directly beneath the playing area, wherein said feeding tube provides for a vertical ball path from said feeding tube inlet to said ball gate to allow said ball to directly fall from said playing area into said ball gate.

19. The ball launcher as set forth in claim 18; wherein said playing area includes a plurality of pockets for receiving the ball launched into the playing area, wherein a detection device is provided for detecting the pocket into which the ball has landed, wherein a position controller is provided for moving the playing area relative to the ball launcher in response to the identified pocket into which the ball has landed such that the identified pocket is brought into registration with the ball launcher and/or with a feeding tube connected to the receiving station of said ball launcher.

* * * * *